US007673978B2

(12) United States Patent
Miura et al.

(10) Patent No.: US 7,673,978 B2
(45) Date of Patent: Mar. 9, 2010

(54) DROPLET EJECTION APPARATUS

(75) Inventors: Hirotsuna Miura, Fujimi (JP); Yuji Iwata, Suwa (JP)

(73) Assignee: Seiko Epson Corporation (JP)

( * ) Notice: Subject to any disclaimer, the term of this patent is extended or adjusted under 35 U.S.C. 154(b) by 637 days.

(21) Appl. No.: 11/600,550

(22) Filed: Nov. 16, 2006

(65) Prior Publication Data

US 2007/0115309 A1 May 24, 2007

(30) Foreign Application Priority Data

Nov. 18, 2005 (JP) ..... 2005-334824
Sep. 21, 2006 (JP) ..... 2006-256166

(51) Int. Cl.
*B41J 2/175* (2006.01)
*B65D 5/72* (2006.01)

(52) U.S. Cl. ..... 347/85; 222/497

(58) Field of Classification Search ..... 347/85, 347/86, 87; 141/2, 18; 222/207, 496, 497
See application file for complete search history.

(56) References Cited

U.S. PATENT DOCUMENTS

| | | | | |
|---|---|---|---|---|
| 6,214,279 | B1 * | 4/2001 | Yang et al. | 264/482 |
| 6,772,917 | B2 * | 8/2004 | Taguchi | 222/203 |
| 6,926,398 | B2 | 8/2005 | Ando et al. | |
| 2004/0226929 | A1 | 11/2004 | Miura et al. | |
| 2005/0008766 | A1 | 1/2005 | Sakurada | |
| 2007/0052787 | A1 | 3/2007 | Miura et al. | |
| 2007/0107658 | A1 | 5/2007 | Sakurada | |

FOREIGN PATENT DOCUMENTS

| | | |
|---|---|---|
| CN | 1470387 | 1/2004 |
| CN | 1532054 | 9/2004 |
| JP | 05-185603 | 7/1993 |
| JP | 08-174860 | 7/1996 |
| JP | 09-290514 | 11/1997 |
| JP | 11-077340 | 3/1999 |
| JP | 2001-225479 | 8/2001 |
| JP | 2002-036583 | 2/2002 |
| JP | 2003-127537 | 5/2003 |
| KR | 2004-0111112 | 12/2004 |
| WO | WO 00/03877 | 1/2000 |

* cited by examiner

*Primary Examiner*—Anh T. N. Vo
(74) *Attorney, Agent, or Firm*—Harness, Dickey & Pierce, P.L.C.

(57) ABSTRACT

A droplet ejection apparatus has an ejection unit that ejects a droplet of liquid onto a target. The ejection unit is arranged in a multi-joint robot. The robot moves the ejection unit in a two-dimensional direction above the target. The ejection unit includes a droplet ejection head, a liquid tank, and an auto-seal valve. The auto-seal valve adjusts the pressure of the liquid supplied from the liquid tank to the droplet ejection head to a predetermined pressure. The auto-seal valve has a valve body that is movable between a closing position and an opening position in correspondence with the difference between the pressure of the liquid in the droplet ejection head and the pressure of the liquid in the liquid tank. The valve body is arranged such that the direction of acceleration that produces force capable of moving the valve body from the closing position to the opening position differs from the direction of acceleration of the ejection unit moving in the two-dimensional direction.

8 Claims, 7 Drawing Sheets

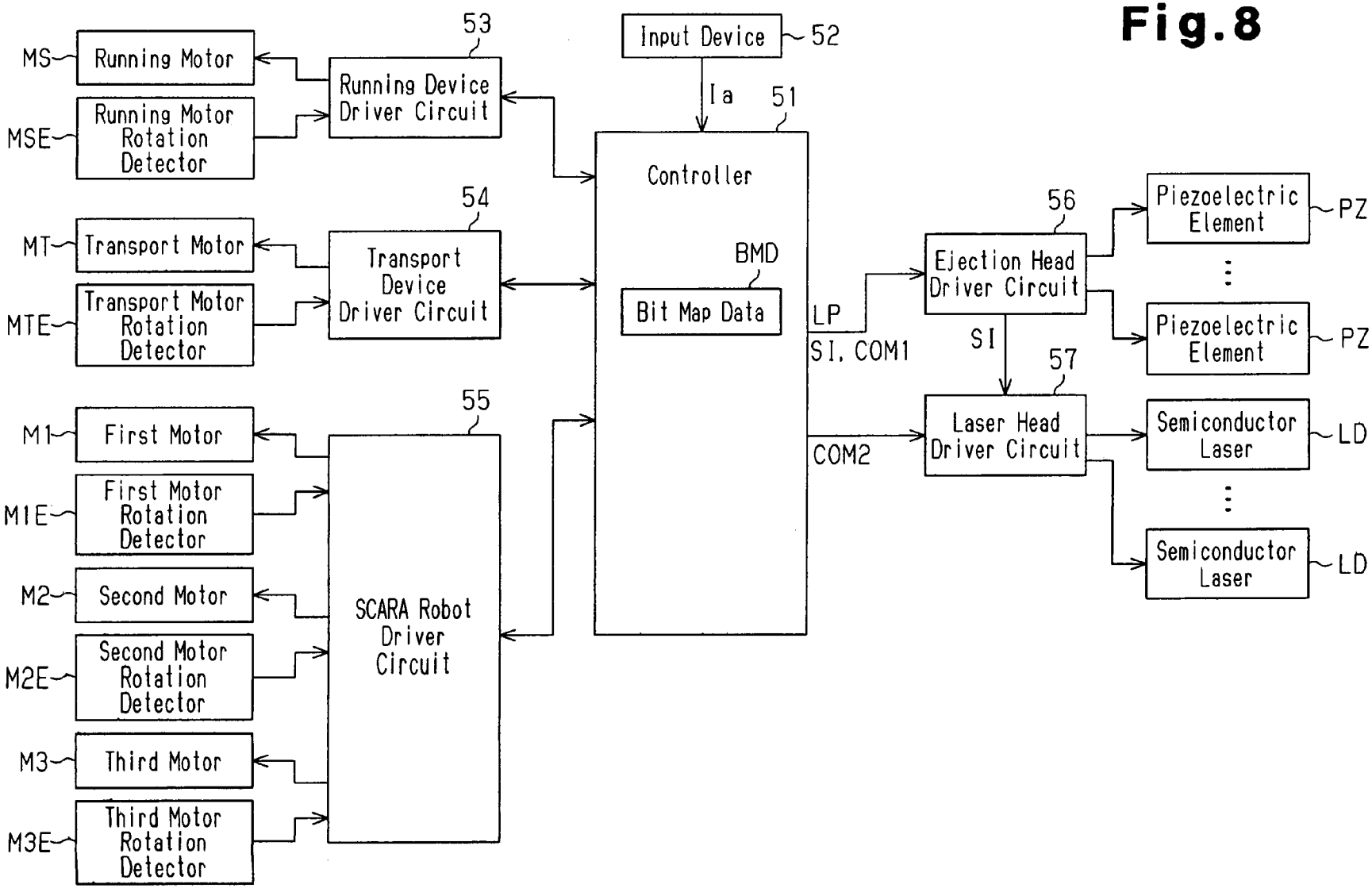
Fig.8
Piezoelectric Element
PZ
Piezoelectric Element
PZ
Semiconductor Laser
LD
Semiconductor Laser
LD
56
Ejection Head Driver Circuit
57
Laser Head Driver Circuit
SI
LP
SI, COM1
COM2
52
Input Device
51
Ia
Controller
BMD
Bit Map Data
53
Running Device Driver Circuit
54
Transport Device Driver Circuit
55
SCARA Robot Driver Circuit
Running Motor
Running Motor Rotation Detector
Transport Motor
Transport Motor Rotation Detector
First Motor
First Motor Rotation Detector
Second Motor
Second Motor Rotation Detector
Third Motor
Third Motor Rotation Detector
MS
MSE
MT
MTE
M1
M1E
M2
M2E
M3
M3E

DROPLET EJECTION APPARATUS

CROSS-REFERENCE TO RELATED APPLICATIONS

This application is based upon and claims the benefit of priority from prior Japanese Patent Application Nos. 2005-334824 filed on Nov. 18, 2005, and 2006-256166 filed on Sep. 21, 2006, the entire contents of which are incorporated herein by reference.

BACKGROUND

The present invention relates to a droplet ejection apparatus.

Typically, a display such as a liquid crystal display or an electroluminescence display includes a substrate that displays an image. The substrate has an identification code (for example, a two-dimensional code) representing product information including the name of the manufacturer and the product number, for purposes of quality control and production control. The identification code includes a plurality of dots formed by, for example, colored thin films or recesses. The dots are arranged to form a predetermined pattern so that the identification code can be identified in accordance with the arrangement pattern of the dots.

As a method for forming one such identification code, JP-A-11-77340 discloses a laser sputtering method and JP-A-2003-127537 discloses a waterjet method. In the laser sputtering method, dots are formed by films provided through sputtering by radiating laser beams onto a metal foil. In the waterjet method, dots are marked on a substrate by ejecting water containing abrasive onto the substrate.

However, in the laser sputtering method, the interval between the metal foil and the substrate must be adjusted to several or several tens of micrometers in order to form each dot in a desired size. The substrate and the metal foil thus must have extremely flat surfaces and adjustment of the interval between the substrate and the metal foil must be carried out with accuracy on the order of micrometer. This limits application of the method to a restricted range of substrates, and use of the method is limited. In the waterjet method, the substrate may be contaminated by water, dust, and the abrasive that are splashed onto the substrate when the dots are marked on the substrate.

In order to solve these problems, an inkjet method has been focused on as an alternative method for forming the identification code. In the inkjet method, dots are formed on a substrate by ejecting droplets of liquid containing metal particles from an ejection head onto the substrate through nozzles. The droplets are then dried to mark the dots on the substrate. The method thus can be applied to a relatively wide range of substrates. Further, the method prevents contamination of the substrate caused by formation of the identification code.

JP-A-8-174860, JP-A-9-290514, JP-A-2001-225479, and JP-A-2002-36583 and Japanese Patent Re-publication No. WO2000/03877 each describes a droplet ejection apparatus used for the inkjet method. The droplet ejection apparatus has a valve mechanism arranged between an ink tank that retains ink and a droplet ejection head. The valve mechanism selectively opens and closes in correspondence with the difference between the pressure of the ink in the ink tank and the pressure of the ink in the droplet ejection head. Specifically, the valve mechanism opens in correspondence with negative pressure caused by consumption of the ink by the droplet ejection head, supplying the ink to the droplet ejection head under stable pressure. The droplet ejection apparatus thus avoids leakage of the ink. Further, the size and the receiving position of each of the droplets are stabilized, improving position accuracy for forming the dots.

To manufacture the aforementioned types of displays, a plurality of identification codes are formed on a single mother substrate so as to enhance productivity for forming the displays. The portions corresponding to the substrates each of which corresponds to one of the identification codes are then cut out from the mother substrate. In this manner, the multiple substrates are obtained from the single mother substrate. In other words, to perform the inkjet method, identification code areas are defined at separate positions on the mother substrate. The droplet ejection head thus operates only when the droplet ejection head is arranged above any one of the code areas. As a result, most of the time necessary for forming the multiple identification codes is consumed by movement of the droplet ejection head from one identification code area to another.

Accordingly, to improve productivity for forming the identification codes by the inkjet method, it is desired that the droplet ejection head is mounted in a multi-joint robot so that the droplet ejection head is transported in two-dimensional direction at high speed.

Japanese Patent Re-publication No. WO2000/03877 describes a structure including a coil spring and a movable film. The coil spring constantly urges the movable film to elastically contact a valve seat. The coil spring receives rocking of the ink caused by movement of the droplet ejection head, stabilizing the pressure in the droplet ejection head. In other words, the coil spring receives the force generated by interaction between acceleration of the droplet ejection head in the two-dimensional direction and the mass of the ink.

However, the structure described by Japanese Patent Re-publication No. WO2000/03877 does not address to the force produced by interaction between the acceleration of the droplet ejection head and the mass of the valve body of the valve mechanism. Thus, if the mass of the valve body or the acceleration of the droplet ejection head is excessively great, the valve body may receive the force acting in the direction of the acceleration of the droplet ejection head, leading to erroneous operation of the valve mechanism.

Further, if the droplet ejection head is arranged in the multi-joint robot, a liquid supply tube connecting the liquid tank to the droplet ejection head may interfere with an arm of the robot. In this case, stable supply of the liquid is hampered.

Therefore, in the droplet ejection apparatus having the droplet ejection head installed in the multi-joint robot, stable droplet ejection by the droplet ejection head is difficult to ensure.

SUMMARY

Accordingly, it is an objective of the present invention to provide a droplet ejection apparatus that stably supplies liquid to a droplet ejection head.

In accordance with one aspect of the present invention a droplet ejection apparatus including a droplet ejection unit and a multi-joint robot is provided. The droplet ejection unit ejects a droplet of liquid onto a target. The droplet ejection unit is mounted in the multi-joint robot. The multi-joint robot moves the droplet ejection unit in a two-dimensional direction above the target. The droplet ejection unit includes a droplet ejection head, a liquid tank, and an auto-seal valve. The droplet ejection head ejects the droplet. The liquid tank retains the liquid at a position above the droplet ejection head. The auto-seal valve is arranged between the droplet ejection head and the liquid tank and adjusts the pressure of the liquid supplied from the liquid tank to the droplet ejection head to a predetermined pressure. The auto-seal valve has a valve body movable between a closing position and an opening position in correspondence with the difference between the pressure of the liquid in the droplet ejection head and the pressure of the liquid in the liquid tank. The valve body is arranged in such a manner that the direction of acceleration that produces force capable of moving the valve body from the closing position to the opening position differs from the direction of acceleration of the droplet ejection unit moving in the two-dimensional direction.

In accordance with another aspect of the present invention, a droplet ejection apparatus including a droplet ejection unit and a multi-joint robot is provided. The droplet ejection unit ejects a droplet of liquid onto a target. The droplet ejection unit is mounted in the multi-joint robot. The multi-joint robot moves the droplet ejection unit in a two-dimensional plane above the target. The droplet ejection unit includes a droplet ejection head, a liquid tank, and an auto-seal valve. The droplet ejection head ejects the droplet. The liquid tank retains the liquid at a position above the droplet ejection head. The auto-seal valve is arranged between the droplet ejection head and the liquid tank and adjusts the pressure of the liquid supplied from the liquid tank to the droplet ejection head to a predetermined pressure. The auto-seal valve has a valve body movable between a closing position and an opening position in correspondence with the difference between the pressure of the liquid in the droplet ejection head and the pressure of the liquid in the liquid tank. The valve body is arranged in such a manner that the movement direction of the center of gravity of the valve body differs from the movement direction of the droplet ejection unit on the two-dimensional plane.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 8 is a block diagram representing the electric configuration of the droplet ejection apparatus of FIG. 2;

DESCRIPTION OF EXEMPLARY EMBODIMENTS

A first embodiment of the present invention will now be described with reference to FIGS. 1 to 8. A liquid crystal display 1 having an identification code 10 formed by a droplet ejection apparatus 20 of the present invention will first be explained.

Figure 1:
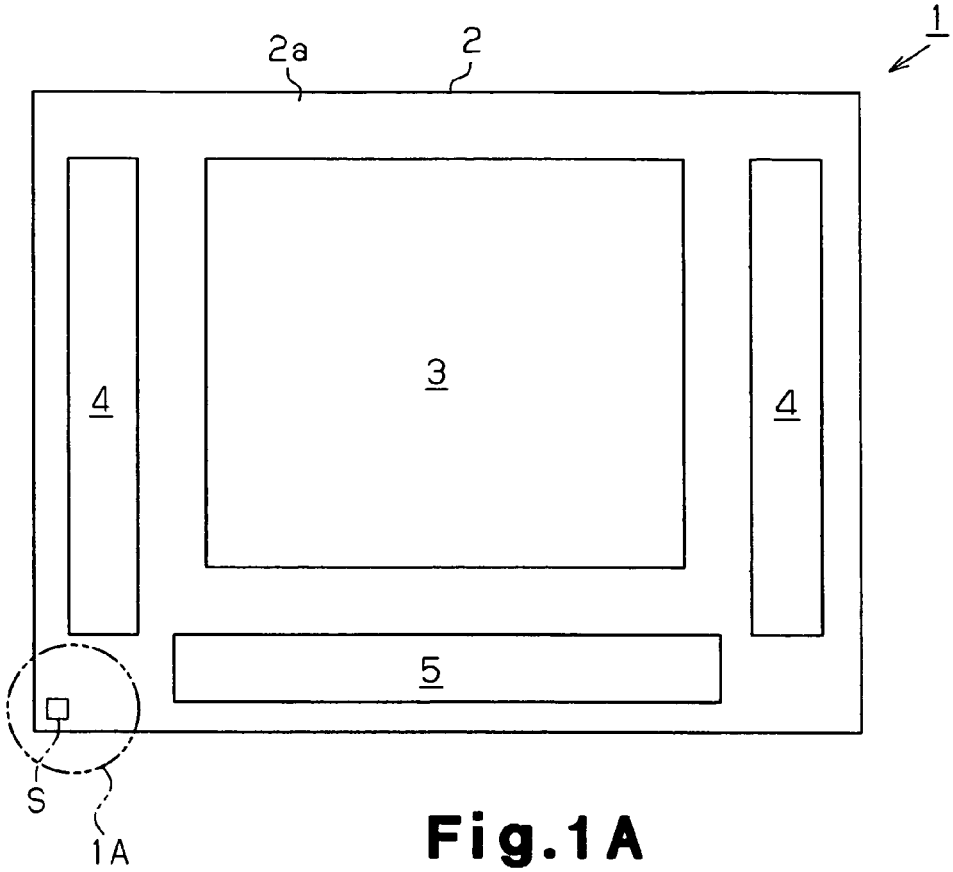
FIG. 1 is a plan view showing a droplet ejection apparatus.
Figure 1A:
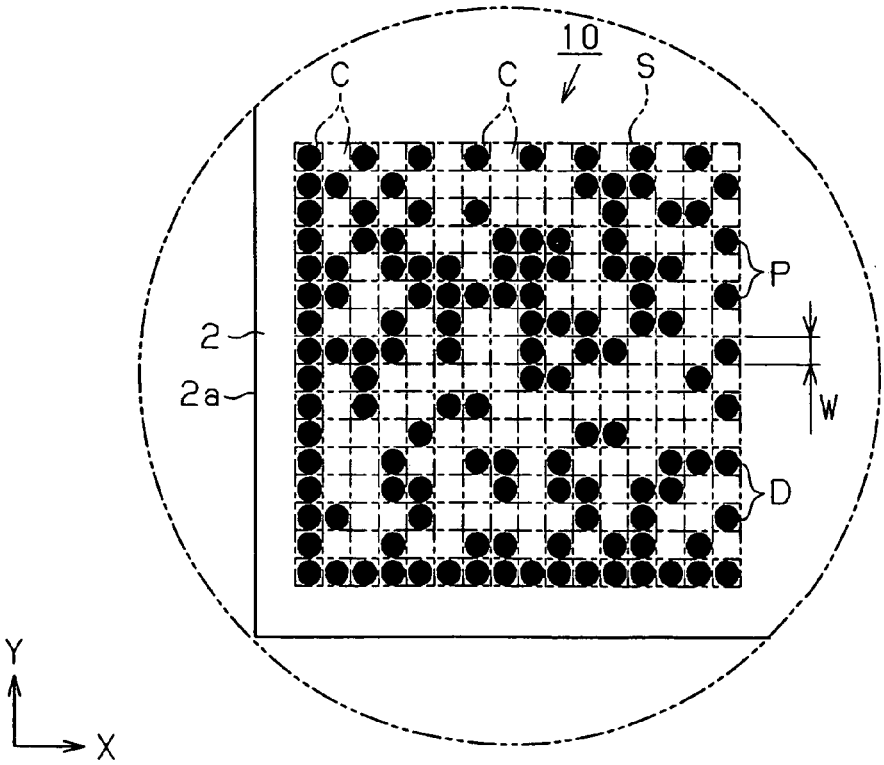
FIG. 1A is an enlarged view showing the portion indicated by circle 1A of FIG. 1.

As shown in FIG. 1, a rectangular display portion 3 in which liquid crystal molecules are sealed is formed substantially at the center of one side surface (a surface 2*a* as an ejection target surface) of a substrate 2. A scanning line driver circuit 4 and a data line driver circuit 5 are provided outside the display portion 3. In correspondence with a scanning signal generated by the scanning line driver circuit 4 and a data signal produced by the data line driver circuit 5, the liquid crystal display 1 adjusts orientation of the liquid crystal molecules in the display portion 3. Area light emitted by a non-illustrated illumination device is modulated depending on the orientation of the liquid crystal molecules. Through such modulation, the liquid crystal display 1 displays a desired image on the display portion 3.

A code area S, which is a square each side of which is approximately one millimeter, is formed in the left corner of the surface 2*a*. The code area S is virtually divided into a plurality of cells (dot forming sections) C that form a matrix of 16 rows by 16 columns. A plurality of dots D, each of which is a mark, are formed in selected ones of the data cells C of the code area S and thus define the identification code 10 of the liquid crystal display 1.

In the first embodiment, the center of each of the data cells C in which the dots D are provided will be referred to as an "ejection target position P". The length of each side of the data cell C will be referred to as the "cell width W".

The outer diameter of each dot D is equal to the length of each side of each data cell C (the cell width W). Each dot D has a semispherical shape. A droplet Fb of liquid F (see FIG. 4) containing metal particles (for example, nickel or manganese particles) dispersed in dispersion medium is ejected onto each of the data cells C and received by the data cell C. Each of the dots D is formed by drying and baking the droplet Fb that has been received by each data cell C. Drying and baking of the droplet Fb in the data cell C is achieved by radiating a laser beam B (see FIG. 4) onto the droplet Fb. Although the dots D are provided by drying and baking the droplets Fb in the first embodiment, the dots D may be formed, for example, simply by drying the droplets Fb by laser beams B.

The dots D formed in the selected data cells C are arranged in a certain pattern, in accordance of which the identification code 10 reproduces the product number and the lot number of the liquid crystal display 1.

In the first embodiment, throughout FIGS. 1 to 7, the longitudinal direction of the substrate 2 will be referred to as direction X and a direction perpendicular to direction X on a plane parallel with the substrate 2 will be referred to as direction Y. A direction perpendicular to directions X and Y will be refereed to as direction Z. Particularly, the directions indicated by the arrows in the drawings will be referred to as direction +X, direction +Y, or direction +Z. The directions opposite to these directions will be referred to direction −X, direction −Y, or direction −Z.

Next, the droplet ejection apparatus 20 for forming the identification code 10 will be described. In the following case, a plurality of identification codes 10 will be formed at different positions on a mother substrate 2M, a mother material for forming multiple substrates 2. The substrates 2 each having the identification code 10 are obtained by cutting apart the mother substrate 2M. The mother substrate 2M is a target onto which the droplets are ejected by the droplet ejection apparatus 20.

Figure 2:
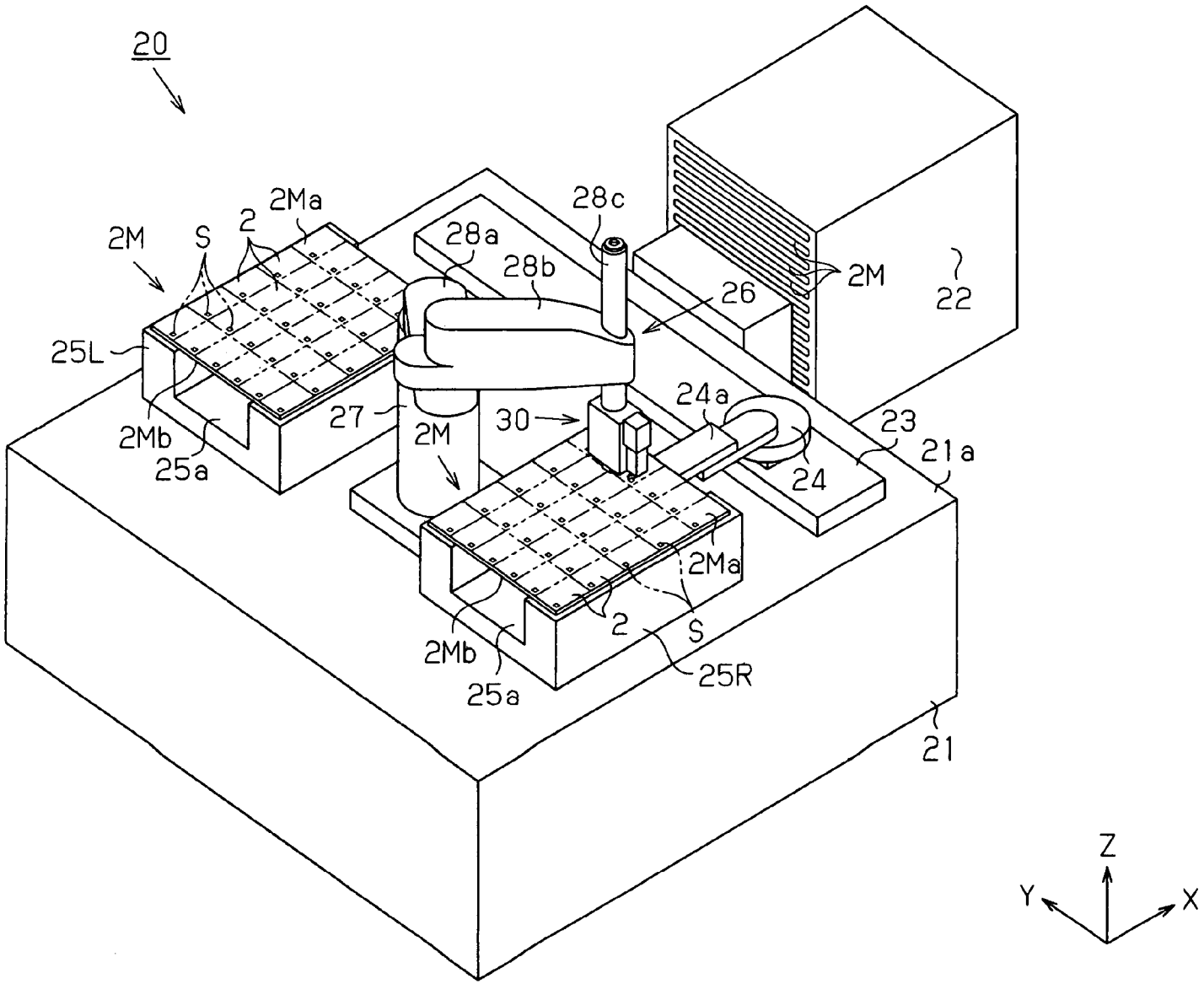
FIG. 2 is a perspective view schematically showing a droplet ejection apparatus according to a first embodiment of the present invention.

As shown in FIG. 2, the droplet ejection apparatus 20 has a base 21, which has a substantially parallelepiped shape and forms the body of the apparatus 20. A substrate stocker 22, which receives multiple mother substrates 2M, is arranged at one side (in direction X) of the base 21. The substrate stocker 22 moves in an up-and-down direction as viewed in FIG. 2 (in direction +Z or direction −Z). This allows each of the mother substrates 2M to be retrieved from the substrate stocker 22, transported to the base 21, and returned to a corresponding slot of the substrate stocker 22.

A running device 23, which extends in direction Y, is arranged on an upper surface 21*a* of the base 21 and at a position close to the substrate stocker 22. A running motor MS (see FIG. 8) is provided in the running device 23. The running device 23 operates a transport device 24, which is operably connected to the output shaft of the running motor MS, to run in direction Y. The transport device 24 is a horizontal articulated robot that has a transport arm 24*a*. The transport arm 24*a* draws and holds a backside 2Mb of each mother substrate 2M. A transport motor MT (see FIG. 8) is arranged in the transport device 24. The transport arm 24*a* is operably connected to the output shaft of the transport motor MT. The transport device 24 extends and contracts or pivots the transport arm 24*a* on a plane including directions X and Y (the X-Y plane) and raises or lowers the transport arm 24*a*.

A pair of mounting tables 25R, 25L are formed on the upper surface 21*a* of the base 21 at opposing sides in direction Y. The corresponding one of the mother substrates 2M is mounted on each of the mounting tables 25R, 25L with a surface 2Ma of the mother substrate 2M facing upward. Each mounting table 25R, 25L defines a space (a recess 25*a*) with respect to the backside 2Mb of the mother substrate 2M. The transport arm 24*a* can be received in and removed from the recess 25*a*. By moving upward or downward in the recess 25*a*, the transport arm 24*a* raises the mother substrate 2M from the mounting table 25R, 25L or places the mother substrate 2M on the mounting table 25R, 25L.

In response to prescribed control signals input to the running motor MS and the transport motor MT, the running device 23 and the transport device 24 retrieve the corresponding one of the mother substrates 2M from the substrate stocker 22 and place the mother substrate 2M on the corresponding one of the mounting tables 25R, 25L. Also, the running device 23 and the transport device 24 re-collect the mother substrates 2M by returning each mother substrate 2M from the mounting table 25R, 25L to a predetermined slot of the substrate stocker 22.

Figure 3:
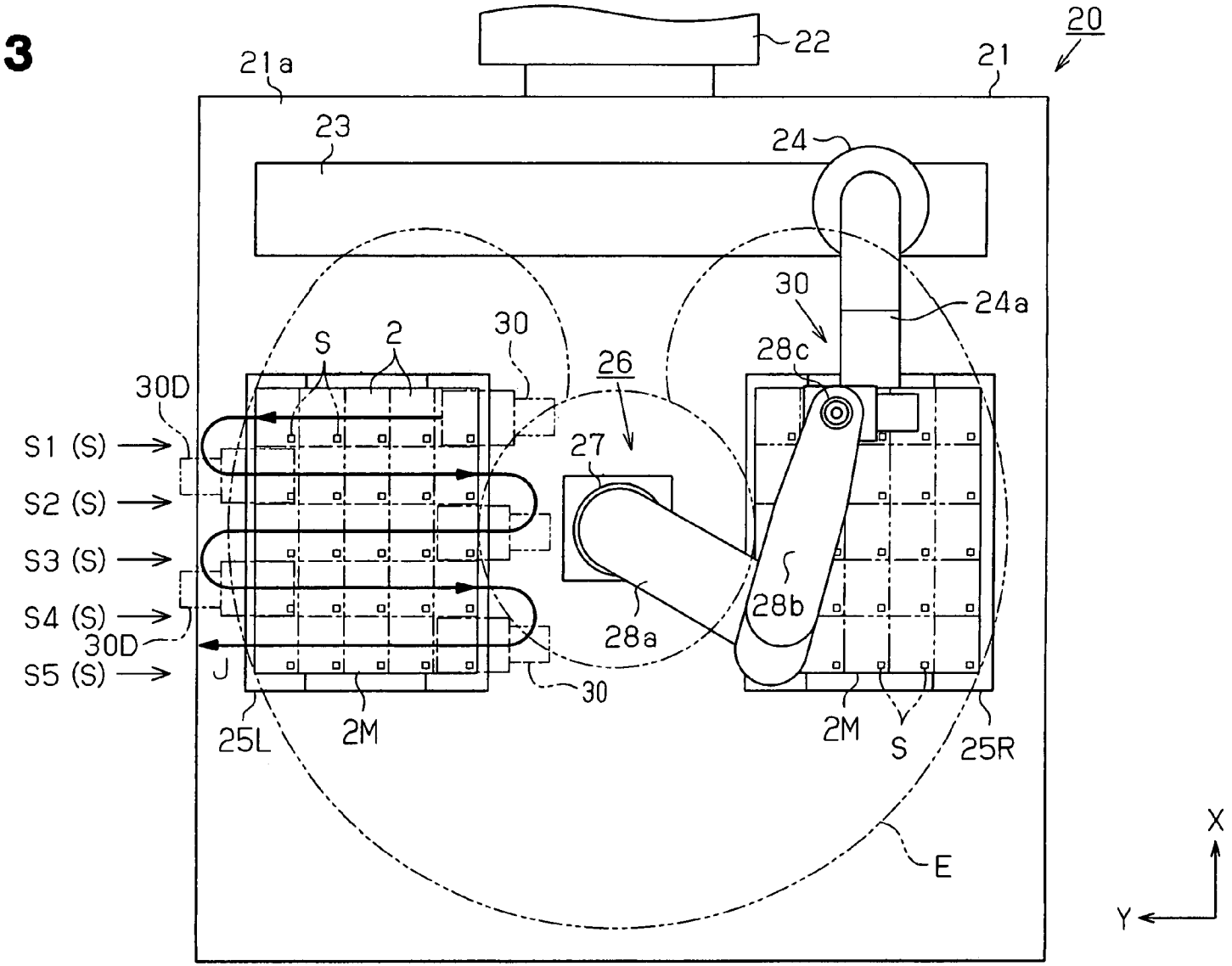
FIG. 3 is a plan view schematically showing the droplet ejection apparatus of FIG. 2.

In the first embodiment, referring to FIG. 3, a code area S is defined on each of the mother substrates 2M mounted on the mounting tables 25R, 25L. In each mother substrate 2M, the rows of the code areas S are defined as the first row of the code areas S1, the second row of the code areas S2, the third row of the code areas S3, the fourth row of the code areas S4, and the fifth row of the code areas S5 sequentially in direction −X, or from the uppermost row to the lowermost row as viewed in FIG. 3.

As shown in FIG. 2, a multi-joint robot (hereinafter, referred to as a SCARA robot) 26 is arranged between the two mounting tables 25R, 25L and on the upper surface 21*a* of the base 21. The SCARA robot 26 has a main shaft 27 that is fixed to the upper surface 21*a* of the base 21 and extends upward (in direction +Z). A first arm 28*a* is provided at the upper end of the main shaft 27. The proximal end of the first arm 28*a* is connected to the output shaft of a first motor M1 (see FIG. 8), which is provided in the main shaft 27. The first arm 28*a* pivots on a horizontal plane, or about a pivotal axis extending in direction Z. A second motor M2 (see FIG. 8) is formed at the proximal end of the first arm 28*a*. The proximal end of a second arm 28*b* is connected to the output shaft of the second motor M2. This allows the second arm 28*b* to pivot on a horizontal plane. A third motor M3 (see FIG. 8) is arranged at the proximal end of the second arm 28*b*. A pillar-like third arm 28*c* is connected to the output shaft of the third motor M3 and thus pivots about a pivotal axis extending in direction Z. A head unit 30, or a droplet ejection unit, is provided at the lower end of the third arm 28*c*.

If the first, second, and third motors M1, M2, M3 receive prescribed control signals, the SCARA robot 26 pivots the corresponding first, second, and third arms 28*a*, 28*b*, 28*c*. In this manner, the head unit 30 scans a scanning area E (an area indicated by the double-dotted chain lines of FIG. 3) defined on the upper surface 21*a*, as viewed in FIG. 3.

Specifically, as indicated by the arrows of FIG. 3, the SCARA robot 26 first pivots the first, second, and third arms 28*a*, 28*b*, 28*c* in such a manner that the head unit 30 scans the first row of the code areas S1 in direction +Y. In such scanning, the SCARA robot 26 moves the head unit 30 at a relatively low speed in zones above the code areas S and at a relatively high speed in zones above the portions between each adjacent pair of the code areas S.

Subsequently, the SCARA robot 26 rotates the head unit 30 at 180 degrees in a counterclockwise direction, together with the third arm 28*c*. The SCARA robot 26 then pivots the first, second, and third arms 28*a*, 28*b*, 28*c* to cause the head unit 30 scan in direction −Y the second row of the code areas S2. In such movement, the SCARA robot 26 moves the head unit 30 at a relatively low speed in zones above the code areas S and at a relatively high speed in zones above the portions between each adjacent pair of the code areas S. Afterwards, in the same manner as has been described, the SCARA robot 26 operates the arms 28*a*, 28*b*, 28*c* in such a manner as to sequentially scan the third, fourth, and fifth rows of the code areas S3, S4, S5 with the head unit 30.

In other words, the SCARA robot 26 of the first embodiment changes the orientation of the head unit 30 in correspondence with the movement direction (the scanning direction J) of the head unit 30, in such a manner that the head unit 30 travels along a zigzag scanning path including all of the zones above the code areas S. The scanning direction J, or the scanning path, of the head unit 30 is defined on the X-Y plane.

Figure 4:
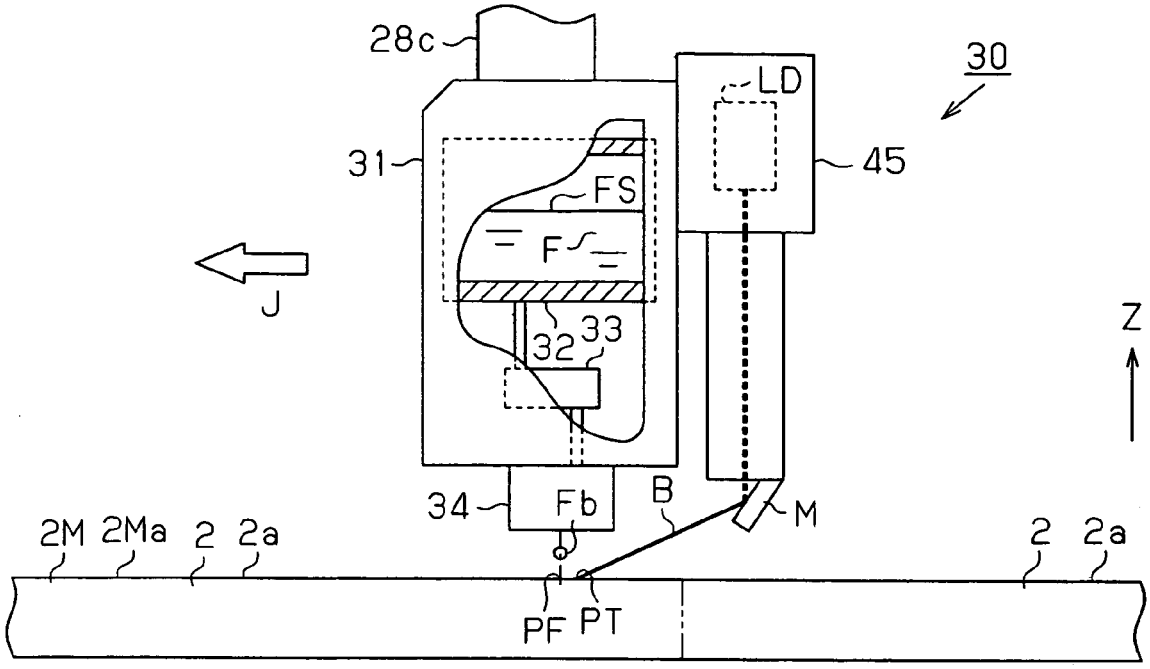
FIG. 4 is a view showing a head unit of the droplet ejection apparatus of FIG. 2.

As shown in FIG. 4, the head unit 30 has a box-like casing 31. A liquid tank 32 and an auto-seal valve 33 arranged below the liquid tank 32 are received in the casing 31. The auto-seal valve 33 communicates with the liquid tank 32. A droplet ejection head (hereinafter, referred to simply as an ejection head) 34 is secured to the lower side of the casing 31 and communicates with the auto-seal valve 33.

The liquid tank 32 retains the liquid F. Using a liquid head pressure difference, the liquid F is sent out of the liquid tank 32 downwardly (toward the auto-seal valve 33 and the ejection head 34) with respect to the liquid surface FS in the liquid tank 32.

Figure 5:
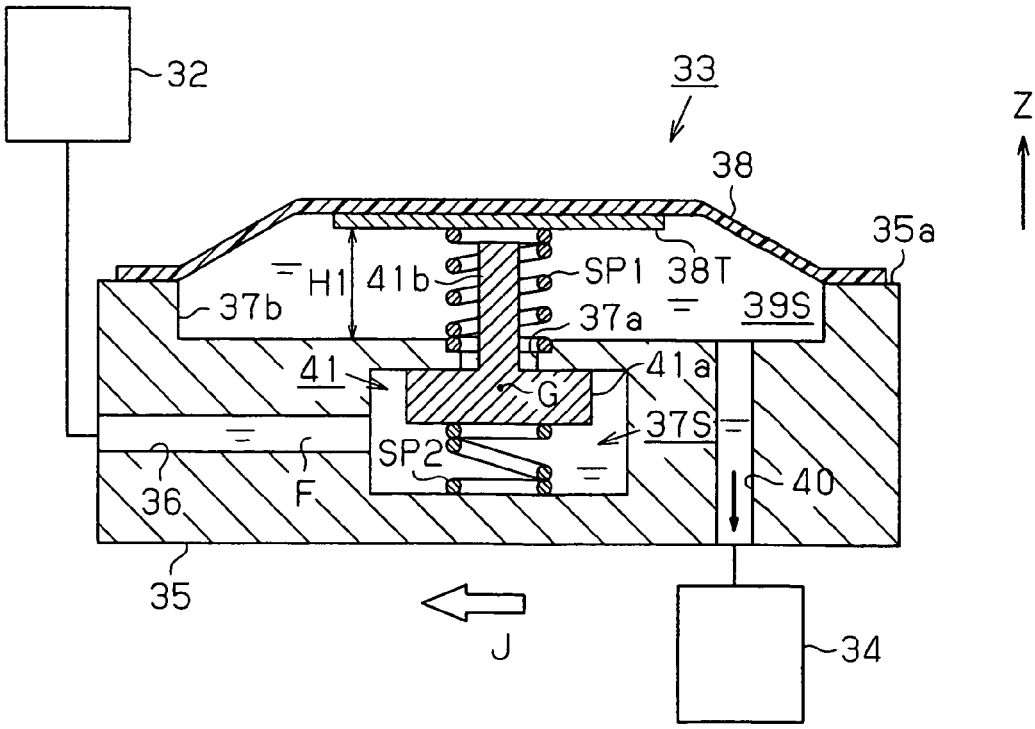
FIG. 5 is a cross-sectional view showing an auto-seal valve provided in the head unit of FIG. 4.

With reference to FIG. 5, the auto-seal valve 33 has an auto-seal valve body 35 in which an inlet line 36 is defined. The inlet line 36 communicates with the liquid tank 32 and sends the liquid F from the liquid tank 32 to the interior of the auto-seal valve body 35. A space having a rectangular cross-sectional shape, or a valve body accommodating chamber 37S connected to the downstream end of the inlet line 36, is formed in the auto-seal valve body 35. The valve body accommodating chamber 37S receives the liquid F flowing from the inlet line 36. The auto-seal valve body 35 has a recess (a pressure receiving recess 37*b*) that is defined above the valve body accommodating chamber 37S. The pressure receiving recess 37*b* has an opening corresponding to an upper surface 35*a* of the auto-seal valve body 35. A circular bore (a communication bore 37*a*) is also defined in the auto-seal valve body 35. The communication bore 37*a* extends in direction Z, allowing communication between the valve body accommodating chamber 37S and the pressure receiving recess 37*b*.

A flexible pressure receiving sheet 38 is applied to the upper surface 35*a* of the auto-seal valve body 35. The pressure receiving sheet 38 flexes in the up-and-down direction (direction Z). The pressure receiving sheet 38 seals the pressure receiving recess 37*b*, thus defining a space (a pressure receiving chamber 39S). The pressure receiving chamber 39S, which is defined by the pressure receiving recess 37*b* and the pressure receiving sheet 38, has a variable volume. The pressure receiving chamber 39S communicates with the valve body accommodating chamber 37S and retains the liquid F.

A pressure receiving plate 38T, which is movable in the up-and-down direction, is bonded with the lower surface of the pressure receiving sheet 38. A coil spring SP1, or an urging member, is provided between the pressure receiving plate 38T and the bottom surface of the pressure receiving recess 37*b*. The coil spring SP1 urges the pressure receiving plate 38T (the pressure receiving sheet 38) upwardly, thus separating the pressure receiving plate 38T (the pressure receiving sheet 38) from the bottom surface of the pressure receiving recess 37*b* in accordance with a predetermined distance (the "constant distance H1"). In the first embodiment, the pressure in the pressure receiving chamber 39S that maintains the distance between the pressure receiving plate 38T and the bottom surface of the pressure receiving recess 37*b* at the "constant distance H1" will be referred to as the "constant pressure".

The auto-seal valve body 35 has an outlet line 40 that extends in direction Z from the bottom surface of the pressure receiving recess 37*b*. The outlet line 40 is a passage that allows communication between the pressure receiving chamber 39S and the ejection head 34 and introduces the liquid F from the pressure receiving chamber 39S to the ejection head 34.

As the liquid F flows from the pressure receiving chamber 39S to the ejection head 34, the pressure in the pressure receiving chamber 39S drops to a level lower than the "constant pressure". The pressure receiving plate 38T (the pressure receiving sheet 38) thus moves downward against the urging force of the coil spring SP1.

A valve body 41 is accommodated in the valve body accommodating chamber 37S. The valve body 41 has a disk-like flange portion 41*a* and a shaft portion 41*b* that extends upward from the center of the flange portion 41*a*. The center of gravity G of the valve body 41 substantially coincides with the center of the flange portion 41*a*. The flange portion 41*a* is received in the valve body accommodating chamber 37S. The shaft portion 41*b* extends into the pressure receiving chamber 39S through the communication bore 37*a*. The communication bore 37*a* allows the valve body 41 to move only upward and downward.

A coil spring SP2, or an urging member that urges the valve body 41 upward, is provided between the lower surface of the valve body 41 and the bottom surface of the valve body accommodating chamber 37S. When the pressure in the pressure receiving chamber 39S is the "constant pressure", the urging force of the coil spring SP2 urges the flange portion 41*a* to contact the ceiling surface of the valve body accommodating chamber 37S. This prohibits communication between the valve body accommodating chamber 37S and the pressure receiving chamber 39S.

The valve body 41 is movable between a "closing position" and an "opening position". When the valve body 41 is arranged at the "closing position", the flange portion 41*a* contacts the ceiling surface of the valve body accommodating chamber 37S. Communication between the valve body accommodating chamber 37S and the pressure receiving chamber 39S is thus prohibited. When the valve body 41 is located at the "opening position", the flange portion 41*a* separates from the ceiling surface of the valve body accommodating chamber 37S, thus allowing the communication between the valve body accommodating chamber 37S and the pressure receiving chamber 39S.

Figure 6:
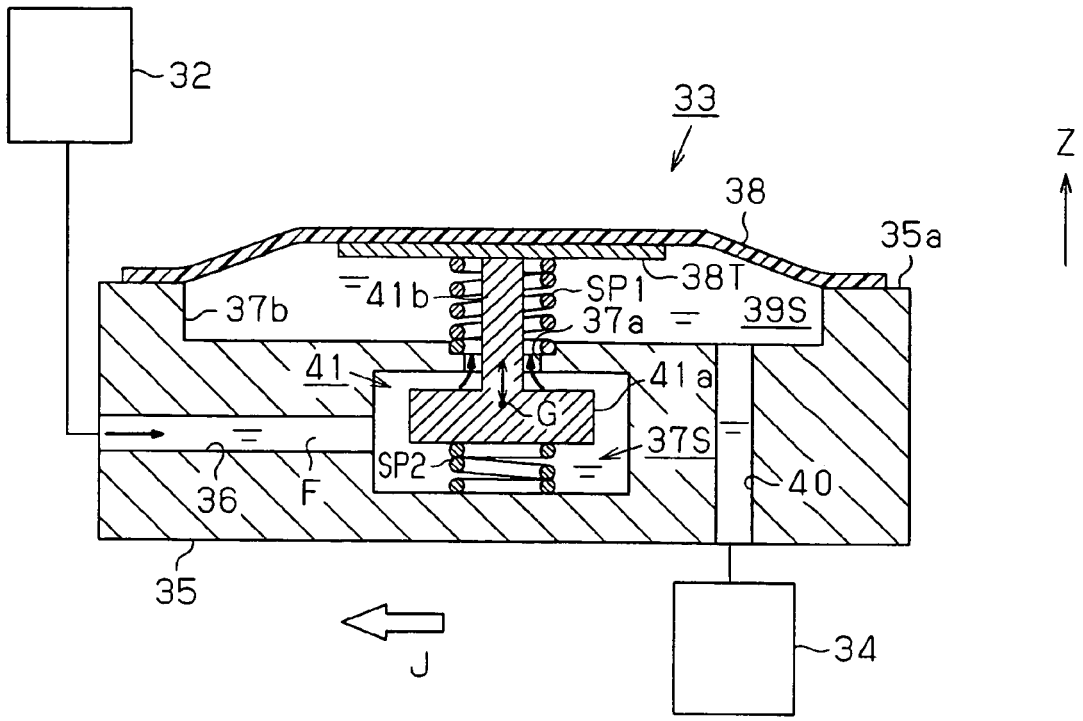
FIG. 6 is a cross-sectional view showing the auto-seal valve of FIG. 5.

Referring to FIG. 6, as the liquid F flows from the pressure receiving chamber 39S to the ejection head 34 and the pressure in the pressure receiving chamber 39S drops to a level lower than the "constant pressure", the pressure receiving plate 38T moves downward against the urging force of the coil spring SP1. This moves the valve body 41 from the "closing position" to the "opening position". When the valve body 41 is arranged at the "opening position", the valve body accommodating chamber 37S communicates with the pressure receiving chamber 39S through the communication bore 37*a*. The liquid F is thus sent from the valve body accommodating chamber 37S to the pressure receiving chamber 39S. This compensates the pressure drop that has occurred in the pressure receiving chamber 39S. When the pressure in the pressure receiving chamber 39S rises to the "constant pressure", the valve body 41 is returned to the "closing position" by the urging force of the coil spring SP1. The communication between the valve body accommodating chamber 37S and the pressure receiving chamber 39S is thus blocked. In other words, the valve body 41 blocks the flow of the liquid F from the valve body accommodating chamber 37S to the pressure receiving chamber 39S, thus maintaining the pressure in the pressure receiving chamber 39S at the "constant pressure". In this manner, the auto-seal valve 33 maintains the pressure of the liquid F supplied to the ejection head 34 at the "constant pressure".

The direction in which the auto-seal valve 33 is opened or closed, or the movement direction of the valve body 41 (the movement direction of the center of gravity G of the valve body 41), corresponds to the up-and-down direction. That is, the movement direction of the valve body 41 is perpendicular to the X-Y plane including the scanning direction J of the head unit 30. The direction of acceleration caused by movement of the head unit 30 on the X-Y plane with respect to the valve body 41 is perpendicular to the movement direction of the valve body 41. Therefore, the auto-seal valve 33 opens or closes optimally in correspondence with the pressure in the pressure receiving chamber 39S, without being influenced by the movement of the head unit 30 on the X-Y plane. The supply pressure of the liquid F is thus effectively maintained at the "constant pressure".

When the head unit 30 is accelerated or decelerated in the scanning direction J (on the X-Y plane), the auto-seal valve 33 (the valve body 41) receives the force (the load) that acts in a direction parallel with the X-Y plane and varies in correspondence with the acceleration of the head unit 30. The acting direction of this force is perpendicular to the movement direction of the center of gravity G of the valve body 41 in opening or closing of the auto-seal valve 33. The auto-seal valve 33 thus opens or closes optimally in correspondence with the pressure in the pressure receiving chamber 39S, without being influenced by acceleration or deceleration of the head unit 30. Accordingly, the auto-seal valve 33 maintains the pressure of the liquid F supplied to the ejection head 34 at the "constant pressure", regardless of the acceleration or the deceleration of the head unit 30.

Figure 7:
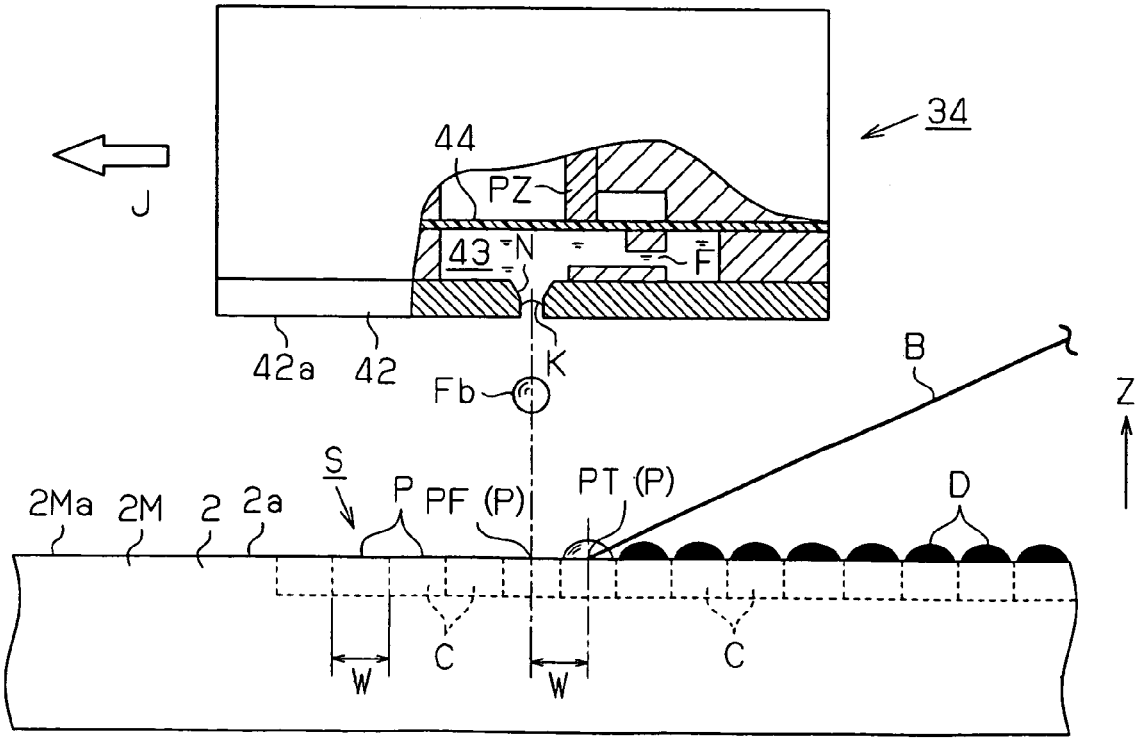
FIG. 7 is a view showing a droplet ejection head.

As shown in FIG. 7, a nozzle plate 42 is formed on the lower surface of the ejection head 34. A plurality of circular bores (nozzles N) are defined in the lower surface (a nozzle surface 42*a*) of the nozzle plate 42, extending in direction Z through the nozzle plate 42 (only one of the nozzles N is shown in FIG. 7). The nozzles N are aligned in a direction perpendicular to the scanning direction J of the head unit 30 (a direction perpendicular to the sheet surface of FIG. 7). The pitch of the nozzles N is equal to the cell width W.

In the first embodiment, the position on the surface 2Ma of the mother substrate 2M immediately below each of the nozzles N will be referred to as a "droplet receiving position PF".

The ejection head 34 has cavities 43 that are defined above the nozzles N and communicate with the auto-seal valve 33 (the outlet line 40). Each of the cavities 43 supplies the liquid F from the auto-seal valve 33 to the interior of the corresponding one of the nozzles N. An oscillation plate 44 is bonded with the upper sides of the walls defining each cavity 43. The oscillation plates 44 each oscillate in the up-and-down direction in such a manner as to increase and decrease the volume of the corresponding one of the cavities 43.

A plurality of piezoelectric elements PZ are arranged on the oscillation plates 44 in correspondence with the nozzles N. In response to a drive signal (drive voltage COM1: see FIG. 8) input to each of the piezoelectric elements PZ, the piezoelectric element PZ contracts and extends in the up-and-down direction at a drive level corresponding to the level of the drive voltage COM1. This oscillates the associated oscillation plate 44 in the up-and-down direction, thus oscillating the interface (the meniscus K) of the liquid F in the corresponding nozzle N in the up-and-down direction.

Each piezoelectric element PZ receives the drive voltage COM1 when the corresponding "droplet receiving position PF" coincides with the "ejection target position P" in the code area S. Driven by the drive voltage COM1, the piezoelectric element PZ oscillates the meniscus K, thus ejecting a predetermined amount of a droplet Fb from the corresponding nozzle N. Since the auto-seal valve 33 stably supplies the liquid F to the ejection head 34, the droplets Fb ejected by the nozzle N is effectively adjusted to the predetermined amount. The droplet Fb then stably travels downward in direction Z and reaches the corresponding droplet receiving position PF (the corresponding ejection target position P). The droplet Fb thus spreads wet on the surface 2Ma and the outer diameter of the droplet Fb becomes equal to the cell width W.

In the first embodiment, the time from when ejection of the droplets Fb starts to when the outer diameter of each droplet Fb becomes equal to the cell width W will be referred to as the "radiation standby time". Movement of the head unit 30 in the "radiation standby time" covers the distance equal to the cell width W.

As shown in FIG. 4, a laser head 45 is formed at a side of the ejection head 34. The laser head 45 is rearward from the ejection head 34 in the scanning direction J. In the laser head 45, a plurality of laser radiation devices (semiconductor lasers LD) corresponding to the nozzles N are aligned in the alignment direction of the nozzles N (a direction perpendicular to the sheet surface of FIG. 4). In response to a drive signal (drive voltage COM2: see FIG. 8) provided to each of the semiconductor lasers LD, the semiconductor laser LD radiates a laser beam B downward in direction Z. The wavelength range of the laser beam B corresponds to the absorption wavelength of each droplet Fb.

An optical system (reflective mirror M) is arranged immediately below the semiconductor lasers LD and extends along the alignment direction of the nozzles N. The reflective mirror M totally reflects the laser beam B radiated by each of the semiconductor lasers LD and guides the laser beam B to the corresponding "radiating position PT". The radiating position PT is located rearward from the corresponding droplet receiving position PF in the scanning direction J.

With reference to FIG. 7, the distance between each droplet receiving position PF and the corresponding radiating position PT is set to a value equal to the distance covered by the movement of the head unit 30 in the radiation standby time, or the cell width W.

Each semiconductor laser LD receives the drive voltage COM2 when the corresponding radiating position PT coincides with the ejection target position P. The semiconductor laser LD thus radiates the laser beam B onto the reflective mirror M. The reflective mirror M then totally reflects the laser beam B and radiates the laser beam B onto the droplet Fb at the radiating position PT. The laser beam B evaporates the solvent or the dispersion medium from the droplet Fb and bakes the metal particles in the droplet Fb at the radiating position PT. In this manner, a dot D having an outer diameter equal to the cell width W is formed at the ejection target position P.

The electric configuration of the droplet ejection apparatus 20, which is configured as above-described, will now be explained with reference to FIG. 8.

As illustrated in FIG. 8, a controller 51 has a CPU, a RAM, and a ROM. In accordance with various types of data and different control programs stored in the ROM, the controller 51 operates the running device 23, the transport device 24, and the SCARA robot 26 while actuating the ejection head 34 and the laser head 45.

An input device 52 having manipulation switches such as a start switch and a stop switch is connected to the controller 51. Through the input device 52, an image of the identification code 10 is input to the controller 51 as a prescribed form of imaging data Ia. In accordance with the imaging data Ia, the controller 51 generates bit map data BMD, the drive voltage COM1 for the piezoelectric elements PZ, and the drive voltage COM2 for the semiconductor lasers LD.

The bit map data BMD indicates whether to turn on or off the piezoelectric elements PZ in accordance with the value of each bit (0 or 1). That is, the bit map data BMD instructs whether to eject the droplets Fb onto the data cells C defined in a two-dimensional imaging plane (the surface 2Ma of each mother substrate 2M).

A running device driver circuit 53 is connected to the controller 51. The running device driver circuit 53 is connected to the running motor MS and a running motor rotation detector MSE. In response to a control signal from the controller 51, the running device driver circuit 53 operates to rotate the running motor MS in a forward direction or a reverse direction. The controller 51 also computes the movement direction and the movement amount of the transport device 24 in correspondence with a detection signal generated by the running motor rotation detector MSE.

A transport device driver circuit 54 is connected to the controller 51. The transport device driver circuit 54 is connected to the transport motor MT and a transport motor rotation detector MTE. In response to a control signal from the controller 51, the transport device driver circuit 54 operates to rotate the transport motor MT in a forward direction or a reverse direction. The controller 51 also computes the movement direction and the movement amount of the transport arm 24*a* in correspondence with a detection signal received from the transport motor rotation detector MTE.

A SCARA robot driver circuit 55 is connected to the controller 51. The SCARA robot driver circuit 55 is connected to the first motor M1, the second motor M2, and the third motor M3. In response to a control signal from the controller 51, the SCARA robot driver circuit 55 operates to rotate the first, second, and third motors M1, M2, M3 in a forward direction or a reverse direction. The SCARA robot driver circuit 55 is connected to a first motor rotation detector M1E, a second motor rotation detector M2E, and a third motor rotation detector M3E. In correspondence with detection signals provided by the first, second, and third motor rotation detectors M1E, M2E, M3E, the SCARA robot driver circuit 55 computes the movement direction and the movement amount of the head unit 30.

The controller 51 moves the head unit 30 in a zigzag manner along the scanning direction J through the SCARA robot driver circuit 55. Also, the controller 51 generates different types of control signals in correspondence with the computation results obtained by the SCARA robot driver circuit 55.

An ejection head driver circuit 56 is connected to the controller 51. The controller 51 sends an ejection timing signal LP synchronized with a prescribed clock signal to the ejection head driver circuit 56. Further, the controller 51 provides the drive voltage COM1 to the ejection head driver circuit 56 synchronously with a prescribed clock signal. The controller 51 also generates ejection control signals SI from the bit map data BMD synchronously with prescribed reference clock signals. The ejection control signals SI are serially transferred to the ejection head driver circuit 56. The ejection head driver circuit 56 converts the ejection control signals SI in the serial forms to parallel signals such that the parallel ejection control signals SI correspond to the piezoelectric elements PZ.

After receiving the ejection timing signal LP from the controller 51, the ejection head driver circuit 56 supplies the drive voltage COM1 to the piezoelectric elements PZ that are selected in accordance with the parallel ejection control signals SI, which have been converted from the serial forms. In other words, the controller 51 operates to eject the droplets Fb from the nozzles N selected in correspondence with the ejection control signals SI (the bit map data BMD) when the droplet receiving positions PF coincide with the corresponding ejection target positions P. The ejected droplets Fb thus reach the ejection target positions P. Further, the ejection head driver circuit 56 outputs the parallel ejection control signal SI to a laser head driver circuit 57.

The laser head driver circuit 57 is connected to the controller 51. The controller 51 supplies the drive voltage COM2 synchronized with a prescribed reference clock signal to the laser head driver circuit 57. After a predetermined time, or the radiation standby time, has elapsed since reception of the ejection control signals SI from the ejection head driver circuit 56, the laser head driver circuit 57 supplies the drive voltage COM2 to the semiconductor lasers LD corresponding to the ejection control signals SI. That is, when the radiation standby time ends, the radiating positions PT coincide with the corresponding ejection target positions P. The controller 51 operates the laser head 45 to radiate the laser beams B when the radiating positions PT coincide with the ejection target positions P.

A procedure for forming the identification code 10 by the droplet ejection apparatus 20 will hereafter be explained.

First, the imaging data Ia is input to the controller 51 by manipulating the input device 52. The controller 51 then operates the running device 23 and the transport device 24 through the running device driver circuit 53 and the transport device driver circuit 54 so that the corresponding mother substrate 2M is retrieved from the substrate stocker 22 and transported to and placed on the mounting table 25R or the mounting table 25L.

Further, the controller 51 generates the bit map data BMD from the imaging data Ia and stores the bit map data BMD. The controller 51 also produces the drive voltage COM1 and the drive voltage COM2. The controller 51 then operates the SCARA robot 26 through the SCARA robot driver circuit 55, starting scanning by the head unit 30. In correspondence with the computation results obtained by the SCARA robot driver circuit 55, the controller 51 determines whether the droplet receiving positions PF, which move together with the head unit 30, have reached the foremost ones of the data cells C (the ejection target positions P). The foremost ones of the data cells C correspond to the rightmost column of the data cells C in the rightmost code area S of the first rows of the code areas S1, as viewed in FIG. 3.

Also, the controller 51 sends the ejection control signals SI and the drive voltage COM1 to the ejection head driver circuit 56 and the drive voltage COM2 to the laser head driver circuit 57.

When the droplet receiving positions PF coincide with the foremost ones of the data cells C (the ejection target positions P), the controller 51 outputs the ejection timing signal LP to the ejection head driver circuit 56. Respondingly, the ejection head driver circuit 56 supplies the drive voltage COM1 to those of the piezoelectric elements PZ that are selected in accordance with the ejection control signals SI. The droplets Fb are thus simultaneously ejected from the corresponding ones of the nozzles N.

Meanwhile, the liquid F is continuously supplied to the nozzles N under stable pressure through pressure adjustment by the auto-seal valve 33. This stabilizes the amount and the traveling direction of each of the ejected droplets Fb. The droplets Fb thus accurately reach the corresponding ejection target positions P. After having reached the ejection target positions P, the droplets Fb spread wet as time elapses. By the time the radiation standby time elapses since starting of ejection of the droplets Fb, the outer diameter of each droplet Fb becomes equal to the cell width W.

Further, the controller 51 sends the parallel ejection control signals SI, which have been converted from the serial forms, to the laser head driver circuit 57 through the ejection head driver circuit 56. After the radiation standby time has elapsed since starting of ejection, or when the radiating positions PT coincide with the corresponding ejection target positions P, the laser head driver circuit 57 supplies the drive voltage COM2 to those of the semiconductor lasers LD that are selected in accordance with the ejection control signals SI. The laser beams B are thus simultaneously radiated by the selected ones of the semiconductor lasers LD.

The laser beams B radiated by the semiconductor lasers LD are then totally reflected by the reflective mirror M and radiated onto the droplets Fb at the radiating positions PT. The solvent or the dispersion medium thus evaporate from the droplets Fb and the metal particles in the droplets Fb are baked. As a result, each of the droplets Fb is fixed to the surface 2Ma as a dot D having an outer diameter equal to the cell width W. In this manner, the dots D are provided in correspondence with the cell width W.

Afterwards, the head unit 30 is transported along the scanning path in the same manner as has been described. Each time the droplet receiving positions PF coincide with the ejection target positions P, the droplets Fb are ejected from the selected nozzles N. The laser beams B are then radiated onto the droplets Fb on the surface 2Ma when the outer diameter of each droplet Fb becomes equal to the cell width W. As a result, the dots D that form a prescribed pattern are provided in each of the code areas S of the mother substrate 2M.

The first embodiment has the following advantages.

(1) The liquid tank 32 and the auto-seal valve 33, together with the ejection head 34, are provided in the SCARA robot 26. The liquid tank 32 supplies the liquid F through a liquid head pressure difference. The auto-seal valve 33 adjusts the pressure of the liquid F supplied from the liquid tank 32 to the constant level. The liquid tank 32 and the auto-seal valve 33 move in the scanning direction J defined on the X-Y plane, together with the ejection head 34.

This configuration shortens the supply line of the liquid F, compared to the case in which the liquid tank 32 and the auto-seal valve 33 are arranged on the base 21. A problem of supply of the liquid F caused by bending of the supply line is thus avoided. As a result, the liquid F is stably supplied to the ejection head 34, which accelerates or decelerates in a two-dimensional direction. This improves productivity for forming the identification codes 10 from the droplets Fb.

(2) The shaft portion 41*b* of the valve body 41 is passed through the communication bore 37*a*, which extends between the valve body accommodating chamber 37S and the pressure receiving chamber 39S. Movement of the valve body 41 is thus allowed solely in the up-and-down direction (direction Z). The auto-seal valve 33 is arranged in such a manner that the direction of acceleration that produces the force capable of moving the valve body 41 becomes perpendicular to the direction of the acceleration of the head unit 30, which moves on the X-Y plane.

In other words, if acceleration acting in direction Z is applied to the valve body 41, the valve body 41 may move in direction Z by receiving the force produced by the acceleration and the mass of the valve body 41. However, in the first embodiment, the direction of the acceleration of the head unit 30 is perpendicular to direction Z. Accordingly, the position of the valve body 41 is effectively adjusted in correspondence with the pressure in the pressure receiving chamber 39S, without being influenced by acceleration or deceleration of the head unit 30. This stabilizes the pressure of the liquid F supplied to the ejection head 34.

(3) The opening or closing direction of the auto-seal valve 33 is perpendicular to the scanning direction J of the head unit 30. Therefore, opening or closing of the auto-seal valve 33 is further reliably controlled. This further stabilizes the pressure of the liquid F supplied to the ejection head 34.

(4) The movement direction of the center of gravity of the valve body 41 coincides with the opening or closing direction of the auto-seal valve 33. This further stabilizes opening or closing of the auto-seal valve 33 and supply of the liquid F to the ejection head 34.

(5) The coil spring SP2 urges the valve body 41 toward the closing position. The opening or closing of the auto-seal valve 33 is thus regulated by the urging force of the coil spring SP2. Accordingly, the pressure of the liquid F supplied to the ejection head 34 is further stabilized.

(6) The laser head 45 is provided in the head unit 30. The laser beams B radiated by the laser head 45 dry the droplets Fb. This improves controllability for shaping the droplets Fb and productivity for forming the identification codes 10.

A second embodiment of the present invention will now be described with reference to FIG. 9. The droplet ejection apparatus 20 of the second embodiment is different from the droplet ejection apparatus 20 of the first embodiment solely in the configuration of the auto-seal valve 33. The following description thus focuses on the modifications to the auto-seal valve 33.

Figure 9:
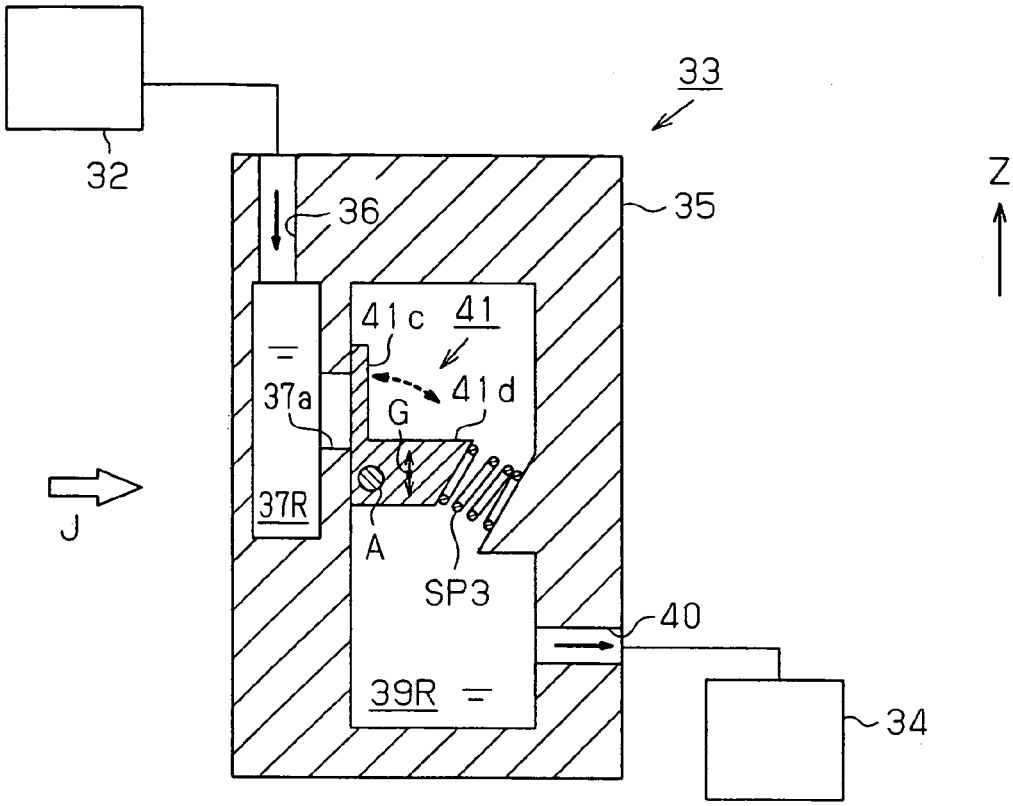
FIG. 9 is a cross-sectional view showing an auto-seal valve according to a second embodiment of the present invention.

As shown in FIG. 9, the auto-seal valve body 35 has an inlet chamber 37R communicating with the inlet line 36, an outlet chamber 39R communicating with the outlet line 40, and a communication bore 37*a* that allows communication between the inlet chamber 37R and the outlet chamber 39R. A pivotal shaft A extending in a direction perpendicular to the sheet surface of the drawing is arranged in the outlet chamber 39R. The outlet chamber 39R receives a valve body 41 having an L-shaped cross-section. The valve body 41 pivots about the pivotal shaft A.

The valve body 41 has a plate-like blocking portion 41*c*. When the blocking portion 41*c* contacts an inner wall of the outlet chamber 39R, communication between the communication bore 37*a* and the outlet chamber 39R is blocked. If the blocking portion 41*c* pivots from this state in a clockwise direction about the pivotal shaft A, the blocking portion 41*c* separates from the inner wall of the outlet chamber 39R. This permits the communication between the communication bore 37*a* and the outlet chamber 39R. In other words, the opening or closing direction of the auto-seal valve 33 coincides with a circumferential direction of a circle about the pivotal shaft A.

The valve body 41 is pivoted between the "closing position" at which the blocking portion 41*c* contacts the inner wall of the outlet chamber 39R and the "opening position" at which the blocking portion 41*c* is separate from the inner wall of the outlet chamber 39R.

A pivotal portion 41*d* is formed at a lower portion of the blocking portion 41*c*. When the valve body 41 is located at the closing position, the blocking portion 41*c* extends in direction Z and the pivotal portion 41*d* extends in the scanning direction J (direction Y) The mass of the pivotal portion 41*d* is greater than the mass of the blocking portion 41*c*. The center of gravity G of the valve body 41 substantially corresponds to the center of the pivotal portion 41*d*. The pivotal portion 41*d* is pivotally supported by the pivotal shaft A passed through the pivotal portion 41*d*. In the auto-seal valve 33 of the second embodiment, the direction of acceleration that produces force capable of pivoting the valve body 41 coincides with the movement direction of the center of gravity G of the valve body 41, or the movement direction of the valve body 41 at a portion corresponding to the center of gravity G, and extends substantially perpendicular to the X-Y plane on which the scanning direction J of the head unit 30 is defined.

A coil spring SP3, or an urging member that urges the pivotal portion 41*d* toward the closing position, is provided between the pivotal portion 41*d* and the inner wall of the outlet chamber 39R.

If the liquid F flows from the outlet chamber 39R to the ejection head 34 and the pressure in the outlet chamber 39R drops to a level lower than a predetermined pressure (the constant pressure), the valve body 41 pivots from the closing position to the opening position against the urging force of the coil spring SP3. When the valve body 41 is located at the opening position, the liquid F is sent from the inlet chamber 37R to the outlet chamber 39R, compensating the pressure drop that has occurred in the outlet chamber 39R. When the pressure in the outlet chamber 39R recovers the constant pressure, the urging force of the spring SP3 acts to pivot the valve body 41 from the opening position to the closing position. This block communication between the inlet chamber 37R and the outlet chamber 39R. Specifically, by prohibiting the flow of the liquid F from the inlet chamber 37R to the outlet chamber 39R, the valve body 41 maintains the pressure in the outlet chamber 39R at the constant pressure. In this manner, the auto-seal valve 33 maintains the pressure of the liquid F supplied to the ejection head 34 at the constant level.

If the head unit 30 accelerates or decelerates in the scanning direction J (on the X-Y plane), the auto-seal valve 33 receives the force (the weight) that acts in a direction parallel with the X-Y plane and varies in correspondence with the acceleration of the head unit 30. The acting direction of this force is perpendicular to the movement direction of the center of gravity G of the valve body 41 in opening or closing of the auto-seal valve 33. This allows the auto-seal valve 33 to optimally open or close in correspondence with the pressure in the outlet chamber 39R, without being influenced by acceleration or deceleration of the head unit 30. The auto-seal valve 33 thus maintains the pressure of the liquid F supplied to the ejection head 34 at the constant pressure, regardless of the acceleration or the deceleration of the head unit 30.

Accordingly, the advantages of the second embodiment are equivalent to the advantages of the first embodiment.

Next, a third embodiment of the present invention will be explained with reference to FIG. 10. The droplet ejection apparatus 20 of the third embodiment differs from the droplet ejection apparatus 20 of the second embodiment only in terms of the configuration of the auto-seal valve 33. Therefore, the modifications to the auto-seal valve 33 will be explained in detail in the following.

Figure 10:
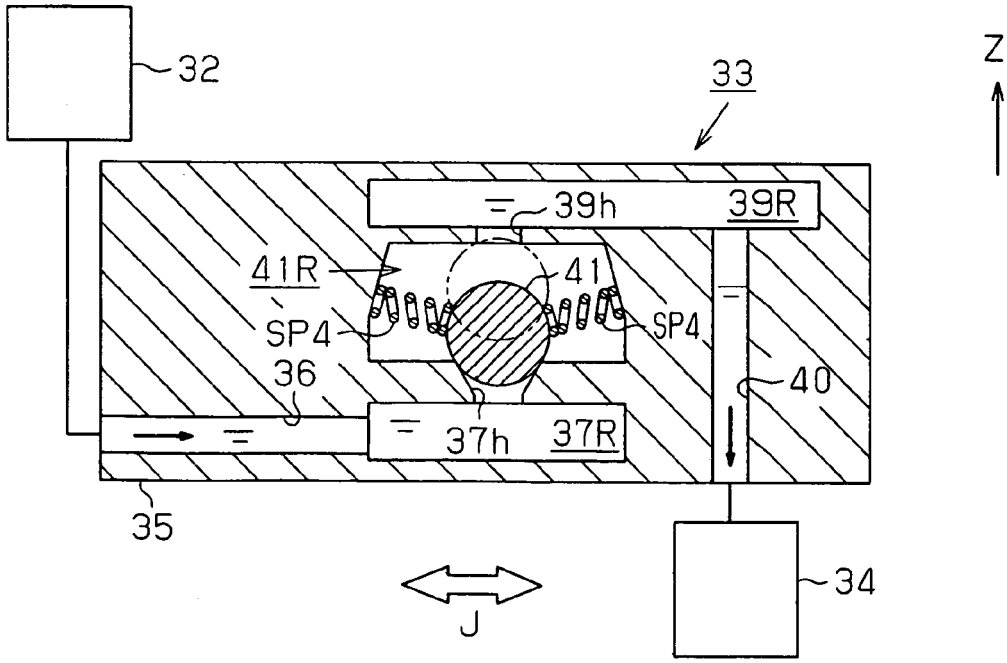
FIG. 10 is a cross-sectional view showing an auto-seal valve according to a third embodiment of the present invention.

As shown in FIG. 10, a valve body accommodating chamber 41R, or a connecting space, is arranged between the inlet chamber 37R and the outlet chamber 39R. The valve body accommodating chamber 41R allows communication between the inlet chamber 37R and the outlet chamber 39R. The valve body 41 having a spherical shape is movably accommodated in the valve body accommodating chamber 41R.

The valve body accommodating chamber 41R and the inlet chamber 37R communicate with each other through a cone-shaped bore (a communication bore 37*h*). As indicated by the corresponding solid lines of FIG. 10, the valve body 41 blocks communication between the valve body accommodating chamber 41R and the inlet chamber 37R by contacting an inner wall of the communication bore 37*h*. In this state, the communication bore 37*h* permits movement of the valve body 41 solely in the up-and-down direction.

The valve body accommodating chamber 41R and the outlet chamber 39R communicate with each other through a circular bore (a communication bore 39*h*). The communication bore 39*h* and the communication bore 37*h* extend coaxially with each other. As indicated by the double-dotted chain lines of FIG. 10, the valve body 41 prohibits communication between the valve body accommodating chamber 41R and the outlet chamber 39R by closing an opening of the communication bore 39*h*.

The valve body 41 is movable between the "first closing position" at which the communication bore 37*h* is closed (indicated by the corresponding solid lines of FIG. 10) and the "second closing position" at which the communication bore 39*h* is closed (indicated by the double-dotted chain lines of the drawing). When the valve body 41 is arranged at a position between the first closing position and the second closing position, which is an "opening position", the inlet chamber 37R and the outlet chamber 39R communicate with each other through the valve body accommodating chamber 41R.

In the third embodiment, the opening or closing direction of the auto-seal valve 33 corresponds to the up-and-down direction (direction Z), or is perpendicular to the scanning direction J of the head unit 30 (the X-Y plane). Further, in the auto-seal valve 33, the two closing positions are set at opposing upper and lower sides of the opening position.

A pair of coil springs (urging members) SP4 are arranged at opposing left and right sides of the valve body 41. The coil springs SP4 urge the valve body 41 toward the first closing position. When the pressure in the outlet chamber 39R is a predetermined pressure (the constant pressure), the urging force produced by the coil springs SP4 acts to maintain the valve body 41 at the first closing position. If the pressure in the outlet chamber 39R drops to a level lower than the constant pressure, the coil springs SP4 permit the valve body 41 to move to the opening position. Further, when the valve body 41 receives acceleration acting in an upward direction at the first closing position, the coil springs SP4 allows the force (the weight) caused by the acceleration and the mass of the valve body 41 to move the valve body 41 to the second closing position.

Therefore, as in the first and second embodiments, the auto-seal valve 33 (the valve body 41) of the third embodiment effectively maintains the pressure of the liquid F supplied to the ejection head 34 at the constant pressure, without being influenced by the force produced by acceleration or deceleration of the head unit 30. Further, even if the head unit 30 receives acceleration acting in an upward or downward direction due to an unexpected oscillation or the like, the auto-seal valve 33 is effectively maintained in a closed state through movement of the valve body 41 between the first closing position and the second closing position.

As an advantage of the third embodiment in addition to the advantages of the first and second embodiments, controllability of operation of the auto-seal valve 33 in the closed state is improved. As a result, the pressure of the liquid F supplied to the ejection head 34 is further stabilized.

The illustrated embodiments may be modified in the following forms.

In the first embodiment, the opening or closing direction of the auto-seal valve 33 and the movement direction of the center of gravity G of the valve body 41 are perpendicular to the scanning direction J of the head unit 30 (the X-Y plane). However, the opening or closing direction of the auto-seal valve 33 and the movement direction of the center of gravity G of the valve body 41 may be set in any suitable manners as long as the directions are inclined with respect to the X-Y plane, or different from the direction of the acceleration of the head unit 30. This widens the range of selection for determining the location of the auto-seal valve 33.

In the first embodiment, the opening or closing direction of the auto-seal valve 33 coincides with the movement direction of the center of gravity G of the valve body 41. However, the valve body 41 that pivots about the center of gravity G may be provided in the auto-seal valve 33 in such a manner that the pivotal direction of the valve body 41 coincides with the opening or closing direction of the auto-seal valve 33. In other words, the opening or closing direction of the auto-seal valve 33 may differ from the movement direction of the center of gravity G of the valve body 41.

In each of the illustrated embodiment, the laser head 45 is provided in the head unit 30. However, the laser head 45 does not necessarily have to be arranged in the head unit 30. In this case, the droplet ejection head 34 may be moved at a higher speed, thus enhancing productivity for forming the identification codes 10.

In each of the illustrated embodiments, the droplets Fb are dried and baked by the laser beams B radiated onto the zones corresponding to the droplets Fb. However, the droplets Fb may be caused to flow in a desired direction by energy produced by the radiation of the laser beams B. Alternatively, the droplets Fb may be subjected to pinning by radiating the laser beams B onto only the outer ends of the droplets Fb. That is, any suitable method may be employed, as long as the marks formed by the droplets Fb are provided through radiation of the laser beams B onto the zones corresponding to the droplets Fb.

Although each of the dots D formed by the droplets Fb has the semispherical shape in the illustrated embodiments, oval dots or linear marks may be provided by the droplets Fb.

In the illustrated embodiments, the ejected droplets Fb form the dots D that define the identification codes 10. However, the droplets Fb may form, for example, different types of thin films, metal wirings, or color filters of the liquid crystal display 1. Alternatively, different types of thin films or metal wirings of a field effect type device (an FED or an SED) may be formed by the droplets Fb. The field effect type device has a flat electron release element that emits light from a fluorescent substance. That is, the droplet ejection apparatus 20 is applicable to any suitable uses, as long as marks are formed by the ejected droplets Fb.

In each of the illustrated embodiments, the target onto which the droplets Fb are ejected is embodied as the substrate 2 of the liquid crystal display 1. However, the target may be a silicone substrate, a flexible substrate, or a metal substrate. In other words, as long as marks are formed by the ejected droplets Fb, any suitable targets may be selected.

The invention claimed is:

1. A droplet ejection apparatus comprising:

a droplet ejection unit that ejects a droplet of liquid onto a target; and a multi-joint robot in which the droplet ejection unit is mounted, the multi-joint robot moving the droplet ejection unit in a two-dimensional direction above the target;

wherein the droplet ejection unit includes:

a droplet ejection head that ejects the droplet;

a liquid tank that retains the liquid at a position above the droplet ejection head; and an auto-seal valve that is arranged between the droplet ejection head and the liquid tank and adjusts the pressure of the liquid supplied from the liquid tank to the droplet ejection head to a predetermined pressure;

wherein the auto-seal valve has a connecting space that connects the liquid tank and the droplet ejection head to each other and a valve body that is located in the connecting space, the valve body being movable between a first closing position, a second closing position and an opening position, the opening position being defined between the first closing position and the second closing position, the valve body prohibiting communication between the liquid tank and the connecting space when located at the first closing position, the valve body prohibiting communication between the droplet ejection head and the connecting space when located at the second closing position, the valve body permitting communication between the liquid tank and the droplet ejection head when located at the opening position, the valve body being arranged in such a manner that the direction of acceleration that produces force capable of moving the valve body from one of the first closing position and the second closing position to the opening position differs from the direction of acceleration of the droplet ejection unit moving in the two-dimensional direction, the valve body between one of the first and second closing positions and the opening position in correspondence with the difference between the pressure of the liquid in the droplet ejection head and the pressure of the liquid in the tank, the valve body being moved from one of the first and second closing positions to the other when receiving acceleration acting in a direction along a movement direction of the valve body.

2. The apparatus according to claim 1, wherein the movement direction of the valve body differs from the direction of the acceleration of the droplet ejection unit moving in the two-dimensional direction.

3. The apparatus according to claim 2, wherein the movement direction of the valve body is substantially perpendicular to the direction of the acceleration of the droplet ejection unit moving in the two-dimensional direction.

4. The apparatus according to claim 1, wherein the movement direction of the center of gravity of the valve body differs from the direction of the acceleration of the droplet ejection unit moving in the two-dimensional direction.

5. The apparatus according to claim 4, wherein the movement direction of the center of gravity of the valve body is substantially perpendicular to the direction of the acceleration of the droplet ejection unit moving in the two-dimensional direction.

6. The apparatus according to claim 1, wherein the auto-seal valve has an urging member that urges the valve body toward the first closing position or the second closing position, and wherein the urging direction of the urging member with respect to the valve body is substantially perpendicular to the direction of the acceleration of the droplet ejection unit moving in the two-dimensional direction.

7. The apparatus according to claim 1, wherein the droplet ejection unit has a laser radiation device that radiates a laser beam onto the droplet received by the target.

8. A droplet ejection apparatus comprising:

a droplet ejection unit that ejects a droplet of liquid onto a target; and a multi-joint robot in which the droplet ejection unit is mounted, the multi-joint robot moving the droplet ejection unit in a two-dimensional plane above the target;

wherein the droplet ejection unit includes:

a droplet ejection head that ejects the droplet;

a liquid tank that retains the liquid at a position above the droplet ejection head; and an auto-seal valve that is arranged between the droplet ejection head and the liquid tank and adjusts the pressure of the liquid supplied from the liquid tank to the droplet ejection head to a predetermined pressure;

wherein the auto-seal valve has a connecting space that connects the liquid tank and the droplet ejection head to each other and a valve body that is located in the connecting space, the valve body being movable between a first closing position, a second closing position and an opening position the opening position being defined between the first closing position and the second closing position, the valve body blocking communication between the liquid tank and the connecting space when located at the first closing position, the valve body prohibiting communication between the droplet ejection head and the connecting space when located at the second closing position, the valve body permitting communication between the liquid tank and the droplet ejection head when located at the opening position, the valve body being arranged in such a manner that the movement direction of the center of gravity of the valve body differs from the movement direction of the droplet ejection unit on the two-dimensional plane, the valve body moving between one of the first and second closing positions and the opening position in correspondence with the difference between the pressure of the liquid in the droplet ejection head and the pressure of the liquid in the liquid tank, the valve body being moved from one of the first and second closing positions to the other when receiving acceleration acting in a direction along a movement direction of the valve body.

* * * * *